United States Patent [19]

Nishikawa et al.

[11] 4,436,678

[45] Mar. 13, 1984

[54] METHOD FOR HOT REPAIRING THE INSIDE OF A FURNACE

[75] Inventors: Yasuo Nishikawa; Hirokuni Takahashi, both of Okayama, Japan

[73] Assignee: Kyusyu Refractories Co., Ltd., Okayama, Japan

[21] Appl. No.: 276,636

[22] Filed: Jun. 23, 1981

[51] Int. Cl.[3] ..... F27D 1/16

[52] U.S. Cl. ..... 264/30; 501/100

[58] Field of Search ..... 264/30; 501/100

[56] References Cited

U.S. PATENT DOCUMENTS

| | | | |
|---|---|---|---|
| 3,737,489 | 6/1973 | Murton | 264/30 |
| 4,102,694 | 7/1978 | Sasaki | 264/30 |
| 4,230,652 | 10/1980 | Allen | 264/30 |
| 4,283,042 | 8/1981 | Kubo | 264/30 |

*Primary Examiner*—John A. Parrish

*Attorney, Agent, or Firm*—Wenderoth, Lind & Ponack

[57] ABSTRACT

The invention relates to the method for hot repairing various kinds of pig iron and steel making furnaces wherein a hot repairing material made in the state of slurry by adding 10-50 weight % water to a monolithic refractory comprising refractory and/or carbon-containing granulated particles and a binder is projected onto a worn part necessitating repairs in the high temperature furnace, the water in the projected hot repairing material boiling under the high heat in the furnace whereby said repairing material is not only fully mixed but also permitted to flow into the minutest recesses of the part necessitating repairs, said repairing material being hardened with the termination of the boiling thereby enabling to form in the worn part a fabricated body having high packing, strength and corrosion resistance.

5 Claims, No Drawings

METHOD FOR HOT REPAIRING THE INSIDE OF A FURNACE

The invention relates to a method for hot repairing the inside of various kinds of pig iron and steel making furnaces, and more particularly to the method of local hot repairing of said various kinds of furnaces, such as a horizontal part, a tilted horizontal part, a part where the repairing material can be held by use of a frame, for example, the charging wall, tapping wall, taphole, bottom of the converter, degassing furnace, charging hole of the pig iron mixing car, etc. (hereinafter referred to as converters, etc.).

Conventionally, the hot repairs of the converter and the like were principally effected by a burning or gunning method. In the converter, the burning repairs were effected by preparing repairing material comprising a basic refractory material, such as magnesia, with tar and pitch added thereto as principal binders, the repairing material being projected onto the part locally susceptible to wear, such as the charging wall, the tapping wall, the taphole, bottom, etc., the repairing material thus projected being burned by the scorching heat of the furnace.

The conventional burning material, however, produced smoke, gas and malodors when burned since it comprised tar and pitch as binders. It was not only detrimental to health for its environmental contamination but also had a disadvantage in that it had to be left as it stood for a long period of 30-70 minutes under the high temperature after the burning process, whereby the converter operational efficiency was reduced.

Furthermore, the burning material was usually projected onto the part necessitating repairs or inserted adjacent said part by placing it on an elongated rod-like tool made of iron. Thus, the operation was accompanied by inefficiency, inconvenience and unreliability.

In order to eliminate the problems involved in industrial hygiene, various binders likely to substitute tar and pitch have been subjected to tests. No satisfactory material, however, has been found that can insure operability and efficiency.

The gunning repairs are usually effected in the part of the converter where the burning repairs are not easily applicable parts, for example, the slug line, trunnion, etc.

The gunning repairs comprise two kinds, the dry system and the wet system. The wet system necessitating preliminary kneading has a disadvantage in that it is not suitable for emergency gunning, susceptible to a change with the passage of time, and liable to cause particle segregation in the slurry tank. The dry system, which is free from these shortcomings has come to be the representative process in recent years.

The dry system gunning material, though free from the defects involved in the wet system, was liable to flake off from the wall with the evaporation of water due to its quicksetting property. Even when it did not flake off, it was liable to set in the loosely filled state resulting in a poorly filled fabricated body having high porosity. Moreover, since it was inevitable to reduce the coarse particle in order to improve its adhesion to the furnace wall (in order to reduce the rebounding loss), the corrosion resistance of the fabricated body was far from satisfactory.

In effect, the burning repairs involved difficulties in respect to operability, though capable of producing a compact layer of high durability, while the gunning repairs had a disadvantage in that the fabricated body had no sufficient durability despite the high operability.

The invention has been accomplished as a result of careful study of the hot repairing method of the converter, and the like, enabling one to obtain high operability and sufficient life by eliminating the aforedescribed difficulties. It has been found that, in case of repairs of a horizontal part, a tilted horizontal part, or a part where the repairing material can be stored by use of a frame, etc., it is not necessary to instantaneously harden the repairing material applied to the furnace wall, it being preferable that the repairing material is adapted to have sufficient fluidity so that it is slowly hardened while boiling with the furnace heat, preferably forming a carbon bond in the ultimate hardening stages, thereby enabling to obtain a compact and highly corrosion-resisting fabricated body; hence the present invention.

In fine, the invention relates to the method for hot repairing the inside of a furnace, comprising the steps of forming a hot repair material in a slurry state rich in fluidity by adding 10–50 weight % water to a monolithic refractory material composed mainly of a refractory material or carbon-containing, granulated particles and added with a binder; pouring said repair material into portions necessitating repairs in the high temperature furnace; allowing the water in said repair material to boil; and hardening said monolithic refractory material after being compacted into said portions in the furnace by the aid of sufficient boiling.

The invention will hereinunder be described in detail.

The particle size distribution of the monolithic refractory constituting the principal ingredient of the repairing material according to the invention is as follows: coarse particles between 1–10 mm up to 10–70 weight %, ultrafine particles below 0.063 mm up to 10–50 weight % and particles between 1–0.063 mm for the residual part, and preferably coarse particles up to 30–60 weight %, ultrafine particles below 0.063 mm up to 15–40 weight % and particles between 1–0.063 mm up to 0–55 weight %, and most preferably coarse particles up to 40–55 weight %, ultrafine particles below 0.063 mm up to 20–30 weight % and particles between 1–0.063 mm up to 15–40 weight %.

If the amount of the coarse particles is less than 10 weight %, the fabricated body thus obtained has insufficient packing and poor corrosion resistance, while if in excess of 70 weight %, the particle segregation phenomenon is liable to arise with the result that the fabricated body has poor packing and insufficient corrosion resistance.

The maximum size of the coarse particle depends on the processing method; a particle size on the order of 5 mm is preferable for the known gunning machine, while particles up to about 10 mm can be used in case of the casting method.

The packing of the fabricated body can be improved with reduced porosity by the use of ultrafine particles below 0.063 mm up to 10–50 weight %, even smaller than the fine particles below 0.125 mm for use in the general gunning method.

The use of the ultrafine particles in excess of 50 weight % has a disadvantage in that not only the cost of the material is uneconomically raised, but also the excessive cohesion of the slurry impairs the packing as well as the corrosion resistance of the refractory. If less than 10 weight %, the packing of the fabricated body is deteriorated, the corrosion resistance being reduced due to increased porosity. Moreover, the refractory materials in the state of slurry is prevented from flowing deep into the small recesses in the part necessitating repairs thereby making it impossible to obtain a fabricated body having a high cohesion.

Accordingly, it is necessary that the aggregate should comprise coarse particles and ultrafine particles in the aforedescribed ratio. According to the invention, the particle size distribution is characterized by a large quantity of coarse and ultrafine particles than usual. This makes it possible to utilize the material with greater effect particularly when combined with the repairing method hereinbefore described.

The refractory materials for use in the invention comprises a basic refractory, such as magnesia, dolomite, magnesia-chromate, etc., neutral refractory, such as chrome ore, alumina-chromate, alumina, etc., and acid refractory, such as clay, agalmatolite, etc. Silicon carbide, graphite, coke and the like may be combined with these refractory materials. They can be appropriately selected in conformity with the kind of wear linings of various furnaces to which the repairing method according to the invention is applied. For example, magnesia, dolomite and other basic refractory materials are preferably used for the repairs of the wear lining of a converter.

In the invention, when the monolithic refractory principally comprises carbon-containing granulated particles consisting of refractory and carbonaceous material, said monolithic refractory is made into the state of slurry in the part necessitating repair in the furnace, said slurry being caused to boil with the furnace heat, the refractory being fully compacted with the boilling force before it is finally hardened. In this case, part of the carbonaceous material in the carbon-containing granulated particles softens and fills the pores of the hardened fabricated body. The carbon bond thus formed permits one to obtain a fabricated body having high packing and corrosion resistance.

The carbon-containing granulated particles are admixtures of 30–90 weight % of a refractory and 10–70 weight % of a carbonaceous material, and the ratio of the carbon-containing granulated particles is 10–70 weight % of the monolithic refractory, preferably 10–60 weight %, and most preferably 20–60 weight %.

If the ratio of the carbon-containing granulated particles is less than 10 weight %, the fabricated body obtained from the hot repairing material has no rigid carbon bond, its slug infiltration resistance being poor. If in excess of 70 weight %, the hot repairing material has a disadvantage in that smoke is emitted during the repairing operation. The carbon-containing granulated particles should preferably have a particle size above 0.5 mm, and more preferably about 1.0 mm. When the particle size is less than 0.5 mm, the fabricated body has poor corrosion resistance, although a carbon bond is more easily formed during the repairing operation. The refractory for use in combination with these carbon-containing granulated particles can be suitably selected from the refractory materials hereinbefore described in detail.

The binder for use in the hot repairing material employed in the hot repairing method according to the invention can be prepared by suitably selecting it in conformity with the kind and particle size distribution of the refractory and the amount of the carbon-containing granulated particles in the repairing material adapted to harden in more than 10 minutes at room temperature (25° C.) and boil and harden in 1–5 minutes during the hot repairing operation.

By controlling the repairing material by means of a binder as hereinabove described, sufficient fluidity required for the maintenance of the boiling state may be imparted to the repairing material in the state of a slurry thereby making it possible to obtain a fabricated body fully compacted with refractory and provided with high corrosion resistance.

The upper limit of the hardening time has been set at 5 minutes provisionally. This provisional limit may more or less vary in conformity with the amount of the repairing material used during the hot repairs though the duration beyond 5 minutes is not desirable in respect of the furnace operation.

Binders may be suitably selected from among those capable of satisfying aforesaid conditions, for example, inorganic binders comprising various alkali condensed phosphates, such as sodium tripolyphosphate, sodium tetrapolyphosphate, sodium pentapolyphosphate and other polyphosphates, sodium hexamethaphosphate and other methaphosphates, various silicates, such as soluble silicate, alkali silicate glass, alkali silicic anhydride, etc., organic binders, comprising carboxymethyl cellulose, methyl cellulose, polyvinyl alcohol, polyvinyl acetate, dextrin, molasses, alginic acid, pulp waste fluid, etc., and various lime sources represented by calcium hydroxide, calcium oxide, etc.

Particularly good results are obtainable from the following combinations:

(1) sodium polyphosphate+sodium metaphosphate
(2) sodium polyphosphate+carboxymethyl cellulose
(3) sodium polyphosphate+sodium methaphosphate+calcium hydroxide
(4) sodium polyphosphate+sodium methaphosphate+calcium hydroxide+sodium silicic anhydride
(5) sodium polyphosphate+sodium methaphosphate+calcium hydroxide+sodium silicate glass
(6) sodium polyphosphate+sodium methaphosphate+calcium hydroxide+sodium silicic anhydride+sodium silicate glass
(7) soluble sodium silicate+calcium hydroxide
(8) soluble sodium silicate+calcium hydroxide+sodium silicate glass
(9) soluble sodium silicate+calcium hydroxide+sodium silicic anhydride
(10) soluble sodium silicate+calcium hydroxide+sodium silicic anhydride+sodium silicate glass The condensed phosphates, such as sodium polyphosphate and sodium methaphosphate, and soluble silicates impart hot strength to the fabricated body, while calcium oxide and calcium hydroxide impart viscosity to the repairing material when added in a smaller amount than in the case of the conventional gunning machine, that is, in an amount less than 0.8 weight % relative to the monolithic refractory. The viscosity can easily be controlled when 3–4 weight % sodium silicate glass is added in combination therewith thereby enabling one to obtain a fabricated body of high packing. The combined use of 1–5 weight % sodium silicic anhydride further improves the chemical adhesion between the fabricated body and the furnace wall. These silicates in reaction to calcium oxide or calcium hydroxide produces highly refractory Ca-Si compounds thereby enhancing the corrosion resistance of the fabricated body.

The repairing material thus prepared is fully mixed and projected together with water into the recess of the part necessitating repairs in the furnace. The water to be added should be in such amount as will hold the repairing material in the state of slurry and maintain such slurry in the boiling state for more than 1 minute. If the water is added in excess, the hardening of the fabricated body will be prolonged to the detriment of the furnace operation.

In view of the foregoing, the amount of water to be added to the monolithic refractory is preferably 15–50 % when the furnace heat is above 1000° C., while 10–40% in case of 100°–1000° C.

The method of projecting the optimum repairing material to be used may be determined in respect to the maximum particle diameter of the monolithic refractory and the location of the part necessitating repairs. The gunning method is preferable in view of greater operability and higher reliability, though any other known method is also applicable, for example, casting, throwing, chute and the like.

The hot repairing method according to the invention will hereinunder be described in detail in connection with the use of a gunning machine.

Initially, a fully mixed monolithic refractory with a fairly large amount of water added thereto (about 30% relative to the repairing material) is applied by hot casting to the part necessitating repairs in the furnace, the fabricated body in the state of slurry being caused to boil with the scorching heat of the furnace wall. Synchronously the furnace wall is cooled thereby to facilitate the adhesion of the repairing material to said furnace wall. In the meantime, the ultrafine particles in the repairing material flow into the fine recesses of the furnace wall thereby presumably preparing a base to facilitate the adhesion of the coarser particles.

Now the hardening process of the fabricated body is terminated after controlling the water of the repairing material in such manner that the surface of the fabricated body is dotted with slow (tiny) boiling phenomena at the termination of the gunning operation. To be more precise, by hot casting the monolithic refractory together with a large amount of water, and since the yield value of said monolithic refractory is set at a low level, the repairing material is subjected to a shearing stress due to the evaporation of water which is greater than the yielding or hardening stress of said repairing material. In this high shearing speed field (the field where high shearing stress works), the flowing unit of the repairing material is reduced thereby which makes the repairing material viscous for a predetermined period of time. Accordingly the repairing material can easily flow into every recess of the part necessitating repairs and adheres to the furnace wall with reliability.

Adjacent the furnace wall, the repairing material is heated close to the temperature of the furnace wall, whereby the local water content is decreased and the shearing stress due to the evaporation of water is accordingly reduced. In this low shearing speed field, the condensation structure of the packing capacity of the repairing material is improved, while the flowability is also increased, thereby enabling the repairing material to be compacted to a highly efficient state of degree.

In case of using a repairing material principally comprising carbon-containing granulated particles, at least part of the carbonaceous material in the carbon-containing granulated particle is softened by the furnace heat, said softened material filling the pores of the fabricated body until it is ultimately integrated with the carbonaceous material in the carbon-containing granulated particles thereby forming a rigid carbon bond. It may be concluded that such phenomenon spreads over the repairing material by degrees starting from the point adjacent the furnace wall until a fabricated body of high compactness is completed.

In the hot repairing method according to the invention, the carbon-containing granulated particles comprise 30–90 weight % of a refractory and 70–10 weight % of a carbonaceous material, and preferably 40–80 weight % of the former and 60–20 weight % of the latter. If the refractory is less than 30 weight % and the carbonaceous material is more than 70 weight %, the corrosion resistance is reduced, while if the refractory is in excess of 90 weight % and the carbonaceous material is below 10 weight %, a rigid carbon bond is not readily formed in the fabricated body, whereby the slug infiltration resistance is accordingly reduced.

The refractory materials for use in the carbon-containing granulated particles can be selected from the group of refractory materials hereinbefore described in detail, while the carbonaceous material is eligible insofar as at least part thereof is softened during the hot repairing and subsequently formed into a carbon bond. The carbonaceous material may be at least one kind selected from the group comprising resins capable of forming rigid a carbon bond through a heat treatment (hereinafter the resins are referred to as carbon resins), such as resinous pitch, phenolic resins, furan resins, etc., pitch, tar, asphalt, etc. In addition, carbon materials such as, plumbago, graphite, waste electrodes, petroleum coke, foundry coke, carbon black, pitch coke, etc. may also be used.

The carbonaceous material preferably comprises three ingredients, that is, at least one kind of the carbon resins, pitch and carbon material, although not restricted to these materials. Resinous pitch is particularly preferable among the carbon resins. The resinous pitch should have a benzol insoluble portion above 30%, and preferably above 45%.

The optimum resinous pitch is one having a very high aromatic property obtainable by subjecting an optional hydrocarbon, such as crude oil, naphtha, asphalt, etc., to a very short heat treatment at 700°–2300° C., and preferably 90°–1600° C., the tarry substance thus produced being subjected to a further heat treatment at 250°–550° C., or by subjecting said hydrocarbon to a very short heat treatment at 500°–1200° C., and preferably 600°–1000° C.

The resinous pitch thus obtained is a uniform mixture of fine particles having a low viscosity at the time of mixing.

The composition of the carbon-containing granulated particles, though not particularly restrictive, is preferably as follows.

refractory: 30–90 weight %
carbon material: 5–25 weight %
carbon resin: 2–20 weight %
pitch: 5–40 weight % and more preferably as follows:

refractory: 40–80 weight %
carbon material: 5–15 weight %
carbon resin: 3–18 weight %
pitch: 5–30 weight %

As described hereinbefore, the invention relates to a novel and epochal method for hot repairing the inside of a furnace, comprising the steps of forming a hot repair material in a slurry state rich in fluidity by adding 10–50 weight % water to a monolithic refractory material composed mainly of a refractory material or carbon containing granulated particles and added with a binder; pouring said repair material into portions necessitating repairs in the high temperature furnace; allowing the water in said repair material to boil; and hardening said monolithic refractory material after being compacted into said portions in the furnace by the aid of sufficient boiling.

The embodiment of the hot repairing method according to the invention enables one to obtain economically a fabricated body, preserving the particle size distribution prior to the treatment as it stands, and having higher adhesion and corrosion resistance over the conventional gunning or firing materials with the minimum loss from bounce. The method according to the invention has a further advantage in that a rigid carbon bond is formed in the fabricated body, the corrosion resistance being usually high, irrespective of the skill of fabrication, to say nothing of the high operability.

The invention will hereinunder be described in more detail in reference to the following examples. In the examples, % represents weight %.

EXAMPLE 1

Samples of repairing material made into the state of slurry by adding 30% water to monolithic refractory comprising sea-water magnesia clinker having the particle size distribution of Table 1 to which has been added 4% of 1:1 admixture of sodium hexamethaphosphate and sodium tetrapolyphosphate as binders were deposited in a gas furnace preliminarily framed with firebricks and held at 1100° C. Then the repairing material in the state of slurry was caused to boil in 2 minutes at 1100° C. and hardened.

The samples thus obtained were left to cool and subjected to the examination of physical properties to obtain the results as shown in Table 1.

By way of comparison, samples of sea-water magnesia clinker having the particle size distribution as shown in Table 1 were hardened in the same manner as in Example 1 to examine the physical properties thereof. The results were as shown in Table 1.

TABLE 1

| | Particle Size Distribution | | | Physical Properties | | |
|---|---|---|---|---|---|---|
| | 1–10 mm | 1–0.063 mm | <0.063 mm | Apparent Porosity | Apparent Specific Gravity | Bulk Specific Gravity |
| Sample of Invention | | | | | | |
| 1 | 60% | 5% | 35% | 28.3% | 3.43 | 2.46 |
| 2 | 60 | 10 | 30 | 27.4 | 3.43 | 2.49 |
| 3 | 60 | 15 | 25 | 27.2 | 3.41 | 2.48 |
| 4 | 60 | 20 | 20 | 27.3 | 3.43 | 2.49 |
| 5 | 60 | 25 | 15 | 29.7 | 3.42 | 2.40 |
| 6 | 50 | 15 | 35 | 28.8 | 3.42 | 2.44 |
| 7 | 50 | 20 | 30 | 27.5 | 3.43 | 2.49 |
| 8 | 50 | 25 | 25 | 27.0 | 3.41 | 2.49 |
| 9 | 50 | 30 | 20 | 27.5 | 3.44 | 2.49 |
| 10 | 50 | 35 | 15 | 28.7 | 3.42 | 2.44 |
| 11 | 40 | 25 | 35 | 29.9 | 3.42 | 2.40 |
| 12 | 40 | 30 | 30 | 28.0 | 3.43 | 2.47 |
| 13 | 40 | 35 | 25 | 27.9 | 3.44 | 2.48 |
| 14 | 40 | 40 | 20 | 28.3 | 3.41 | 2.44 |
| 15 | 40 | 45 | 15 | 29.8 | 3.42 | 2.40 |
| Comparative Sample | | | | | | |
| 1 | 60 | 35 | 5 | 33.8 | 3.42 | 2.26 |
| 2 | 50 | 45 | 5 | 32.8 | 3.45 | 2.32 |
| 3 | 40 | 55 | 5 | 32.5 | 3.43 | 2.32 |
| 4 | 30 | 65 | 5 | 33.3 | 3.41 | 2.28 |
| 5 | 20 | 75 | 5 | 34.4 | 3.42 | 2.24 |
| 6 | 10 | 85 | 5 | 35.1 | 3.44 | 2.24 |
| 7 | 5 | 50 | 45 | 34.0 | 3.45 | 2.28 |
| 8 | 5 | 65 | 30 | 33.5 | 3.43 | 2.28 |
| 9 | 5 | 80 | 15 | 32.9 | 3.44 | 2.31 |

As is apparent from Table 1, the samples according to the invention comprising 10–70% coarse particles above 1–10 mm and 10–50% ultrafine particles below 0.063 mm showed superior physical properties to those of the comparative samples.

EXAMPLE 2

Samples were produced same as in Example 1 by use of repairing material in which the amounts of sodium hexamethaphosphate and sodium tetrapolyphosphate as binders had been controlled so that the slurries obtained by adding 30% water to sea-water magnesia clinker having the particle size distributions as shown in Table 2 hardened in about 20, 60, 180 and 420 minutes respectively at room temperature (25° C.).

By way of comparison, samples were produced by use of a quicksetting binder comprising 5% sodium hexamethaphosphate and 4% calcium hydroxide for use in the conventional gunning method.

The hardening time was stipulated to be the space of time until a conic weight of 75 g placed on the slurry ceased to sink beyond 10 mm.

TABLE 2

| | | Sample of Invention | | | | Comparative Sample | |
|---|---|---|---|---|---|---|---|
| | | A | B | C | D | E | F |
| Particle Size Distribution | 1–10 mm (%) | 50 | 50 | 50 | 50 | 50 | 20 |
| | 1–0.063 mm (%) | 27 | 27 | 27 | 27 | 27 | 52 |
| | <0.063 mm (%) | 23 | 23 | 23 | 23 | 23 | 28 |
| Hardening Time (min) 25° C. | | 420 | 180 | 60 | 20 | <5 | <5 |
| Physical Properties | Boiling Time (sec) | 240 | 150 | 90 | 60 | <3 | <3 |
| | Apparent Porosity (%) | 27.8 | 28.2 | 27.5 | 28.9 | 39.5 | 41.2 |
| | Apparent Specific Gravity | 3.44 | 3.43 | 3.42 | 3.44 | 3.43 | 3.42 |
| | Bulk Specific Gravity | 2.48 | 2.48 | 2.48 | 2.45 | 2.07 | 2.01 |
| | Normal Temperature Crushing Strength (kg/cm$^2$) | 25 | 18 | 13 | 9 | <2 | <2 |

As is apparent from Table 2, the samples according to the invention, the hardening time of which is controlled within the range from 20 to 420 minutes at room temperature (25° C.), show a boiling time of 1 to 4 minutes under heat (1100° C.), respectively. Since the slurry has been sufficiently boiled, the hardened fabricated bodies have apparent porosities ranging from 27 to 29% thereby improving the physical properties.

On the contrary, the comparative samples, which have been hardened prior to sufficient boiling by use of the conventional quick-setting binder, show very high apparent porosities ranging from 39 to 41% even when the particle size distributions are the same as those of the samples according to the invention.

EXAMPLE 3

The amounts of binders, sodium hexamethaphosphate and sodium tetrapolyphosphate, were controlled so that the slurry obtained by adding 15-40% water to sea-water magnesia clinker having particle size distributions as shown in Table 3 (in Composition D alone, electrofused alumina was used as a refractory material) hardened in about 20 minutes and 420 minutes respectively at room temperature (25° C.). The results as shown in Table 3 were obtained same as in Example 1.

The conventional gunning material and hardening agent were used for the comparative sample.

TABLE 3

| | Sample of Invention | | | | | | Comparative Sample Conventional Gunning Material |
|---|---|---|---|---|---|---|---|
| | A | B | C | D | E | F | |
| Particle Size Distribution (%) | | | | | | | |
| 10–5 mm | | 10 | | | | | |
| 5–1 mm | 40 | 40 | 60 | 40 | 50 | 60 | 30 |
| 1–0.063 mm | 35 | 25 | 10 | 35 | 25 | 10 | 45 |
| <0.063 mm | 25 | 25 | 30 | 25 | 25 | 30 | 25 |
| Hardening Time of Room Temp. (min) | | 420 | | | 20 | | <5 |
| Apparent Porosity (%) | | | | | | | |
| Amount of Water Added | | | | | | | |
| 15% | 34.2 | 32.5 | 31.5 | 35.8 | 32.1 | 31.1 | 35.8 |
| 20% | 29.9 | 30.1 | 29.5 | 31.1 | 29.0 | 30.0 | 36.4 |
| 25% | 28.5 | 27.1 | 27.0 | 29.6 | 28.4 | 29.1 | 35.8 |
| 30% | 27.5 | 26.9 | 27.3 | 28.8 | 28.0 | 27.5 | 36.1 |
| 35% | 29.3 | 27.5 | 28.1 | 28.6 | 27.8 | 27.2 | 39.2 |
| 40% | 31.2 | 28.4 | 28.5 | 30.3 | 28.9 | 29.1 | 40.0 |

As Table 3 shows clearly, in the conventional gunning material, not only the particle size distribution of the aggregate is unsuitable but also the binder is quick-setting. Thus, while the primary filling is unsatisfactory, the material is hardened synchronously with hot casting thereby completely precluding the phenomenon of the secondary filling. The porosity, therefore, can never be reduced by the simple change of the amount of the water.

On the contrary, in the samples according to the invention, not only the primary filling is effected satisfactorily but also the material is filled and hardened by degrees while boiling for several minutes after hot casting, whereby the porosity is far reduced below that of the conventional gunning material. The period of time between the boiling and hardening greatly depends on the amount of water, to say nothing of the amount of the binder. If the amount of water is less than 10%, the hot hardening time is curtailed with the result that the porosity is increased. Thus, the amount of water to be added is preferably within the range from 10 to 40%.

EXAMPLE 4

On a charging wall of a 300-ton converter of A Iron Mill, at the state above 2500 ch, the repairing material of Composition No. 9 shown in Example 1 was hot cast by means of a dry gunning machine so that the amount of water was about 30%, the repairing material in the state of slurry was boiled for about 3 minutes, left as it stood for 5 minutes, and then burned.

As a result, the adhesion was found to be satisfactory with a life of 3–5 ch. According to the method of the invention, the same life as that of the conventional burning material is shown by using 200t/one life. Not only the prime unit of the material was reduced to $\frac{1}{3}$–$\frac{1}{4}$ compared with the case of the conventional burning, but also the working time was curtailed to $\frac{1}{3}$ per operation.

EXAMPLE 5

A frame made of magnesia bricks having a thickness of 25 mm was provided on the taphole of a 300t converter of A Iron Mill. Repairing material of Composition No. 9 of Example 1 in the amount of 500–800 kg was hot cast by means of a dry gunning machine so that the amount of water was about 30%, boiled for about 15 minutes, left as it stood for about 10 minutes, and then burned.

As a result, the adhesion was found satisfactory with the life for the discharge of about 3000t. The life according to the invention was 1–2 times longer compared with the case of the repairing method by means of a conventional burning or gunning material. Moreover, the prime unit of the material could be reduced to $\frac{1}{2}$–$\frac{1}{3}$ below that of the conventional method.

EXAMPLE 6

Repairing materials in which the amounts of sodium hexamethaphosphate and sodium tetrapolyphosphate as binders were controlled so that the slurry obtainable by adding 30% of water to a magnesia clinker (particle size distribution as shown in Table 4) and carbon-containing granulated particles (particle size distribution as shown in Table 5) hardens in about 120–150 minutes at room temperature (25° C.) were deposited in a gas furnace preliminarily framed by means of firebricks and sustained at a temperature of 1200° C.

Then the repairing materials were boiled and hardened at 1200° C. The hardened bodies thus obtained were left to cool and subjected to various tests. The results were as shown in Table 4.

The hardening time was stipulated to be the period of time until a conic weight of 75 g placed on the repairing material ceased to sink any further than 10 mm.

By way of comparison, there were prepared a sample comprising carbon-containing granulated particles in an excessive ratio of 80% (comparative sample No.1), a sample comprising 5% ultrafine particles below 0.063 mm (comparative sample No.2), a sample comprising 30% petroleum coke granulated particles (comparative sample No.3) and the comparative gunning material (comparative sample No.4).

In Table 4, the carbon-containing granulated particles (A and B) and the petroleum coke (C) are same as those shown in Table 5. The slug test was made by cutting the hardened bodies obtained by hot casting at 1200° C. and subjecting same to converter slug at 1650° C. for 3 hours.

Table 5 shows the mixing ratio and physical properties of the carbon-containing granulated particles (A, B) and petroleum coke (C) of Table 4, wherein the values enclosed in parentheses are represented with the main material being 100 weight %.

TABLE 4

| | | | Sample of Invention | | | Comparative Sample | | | |
|---|---|---|---|---|---|---|---|---|---|
| | | | 1 | 2 | 3 | 1 | 2 | 3 | 4 |
| Mixing Ratio | Carbon-Containing Granulated Particle | | | | | | | | |
| | (A) 5-1 mm | | 50% | 30% | | 60% | 50% | | |
| | 1-0.5 mm | | 5 | | | 20 | 5 | | |
| | Carbon-Containing Granulated Particle | | | | | | | | |
| | (B) 5-1 mm | | | | 20% | | | | |
| | 1-0.5 mm | | | | 5 | | | | |
| | Petroleum Coke | | | | | | | | |
| | (C) 5-1 mm | | | | | | | 30% | |
| | Magnesia | | | | | | | | |
| | Clinker 5-1 mm | | | 20 | 30 | | | 10 | 50% |
| | Clinker 1-0.063 mm | | 23 | 25 | 18 | | 40 | 35 | 45 |
| | Clinker <0.063 mm | | 22 | 25 | 27 | 20 | 5 | 25 | 5 |
| | Content (%) MgO | | 76.7 | 83.1 | 77.1 | 70.4 | 76.9 | 63.4 | 90.7 |
| | F.C. | | 8.5 | 4.6 | 10.2 | 10.8 | 8.5 | 28.7 | — |
| | Hardening time (min) 25° C. | | 140 | 150 | 120 | 150 | 160 | 120 | <5 |
| | Boiling time (sec) | | 120 | 125 | 110 | 125 | 130 | 110 | 100 |
| Test Result | Physical Properties | Apparent Porosity (%) | 36.8 | 31.5 | 37.8 | 43.5 | 40.2 | 38.5 | 32.8 |
| | | Apparent Specific Gravity | 3.20 | 3.25 | 3.15 | 3.17 | 3.21 | 3.12 | 3.45 |
| | | Bulk Specific Gravity | 2.02 | 2.23 | 1.96 | 1.79 | 1.92 | 1.92 | 2.32 |
| | | Normal Temperature Crushing Strength (kg/cm$^2$) | 20 | 25 | 19 | 6 | 13 | 2 | 8 |
| | | Hot Crushing Strength at 1200° C. (kg/cm$^2$) | 38 | 30 | 29 | 15 | 22 | 3 | 3 |
| | | Loaded Softening Point ($T_2$, °C.) | 1450 | 1320 | 1400 | 1120 | 1320 | 970 | 1010 |
| | Slug Test Result | Max. Corrosion (mm) | 10 | 7 | 9 | 15 | 21 | 25 | 15 |
| | | Max. Slug Infiltration Depth (mm) | 2 | 5 | 2 | 1 | 2 | 2 | 28 |

TABLE 5

| | | Sample of Invention | | Comparative Sample |
|---|---|---|---|---|
| | | A | B | C |
| Mixing Ratio | Magnesia | | | |
| | Clinker 3-1 mm | 70% | | |
| | Clinker <0.5 mm | 10 | 40% | |
| | Plumbago <0.5 mm | 5 | 20 | |
| | Resinous Pitch <0.125 mm | 15 | 10 | |
| | Hard Pitch <0.125 mm | | 30 | |
| | Medium Pitch | (5) | | |
| | Anthracene Oil | (4) | | |
| | Sodium Phosphate | (3) | | |
| | Petroleum Coke 5-1 mm | | | 100% |
| | Content (%) MgO | 68.6 | 38.1 | — |
| | F.C | 16.2 | 43.0 | 99.5 |
| Physical Properties | Apparent Porosity (%) | 1.2 | 3.0 | 23.5 |
| | Apparent Specific Gravity | 2.50 | 2.15 | 2.00 |
| | Bulk Specific Gravity | 2.47 | 2.08 | 1.53 |

EXAMPLE 7

Samples of repairing material made in the state of slurry by adding 35% water to monolithic refractory comprising magnesia clinker and carbon-containing granulated particles having the particle size distributions as shown in Table 6 with binders as shown in Table 7 added thereto respectively were deposited in a gas furnace preliminarily framed by means of firebricks and sustained at a temperature of about 1200° C. Said samples of the repairing material were boiled and hardened at about 1200° C.

The adhesion shearing stress of each sample relative to the framed firebricks at about 1200° C. and 1400° C. respectively was examined, while the physical properties of each sample were measured after cooling. The results were as shown in Table 6.

TABLE 6

| | Example | 1 | 2 | 3 | 4 | 5 | 6 | 7 | 8 | 9 |
|---|---|---|---|---|---|---|---|---|---|---|
| Mixing Ratio | Carbon Containing Granulated Particle A 5-1 mm | | | | | 50 | 50 | | | |
| | Particle A 1-0.5 mm | | | | | 5 | 5 | | | |
| | Magnesia Clinker 5-1 mm | 50 | 50 | 50 | 50 | | | 50 | 50 | 50 |
| | Clinker 1-0.063 mm | 24 | 24 | 24 | 24 | 19 | 19 | 24 | 24 | 24 |
| | Clinker <0.063 mm | 26 | 26 | 26 | 26 | 26 | 26 | 26 | 26 | 26 |
| | Kind of Binders | 3 | 4 | 8 | 10 | 4 | 10 | 2 | a | b |
| Test Result | Boiling Time (sec) | 80 | 71 | 75 | 81 | 83 | 80 | 75 | 72 | 78 |
| | Apparent Porosity (%) | 27.8 | 27.7 | 27.5 | 27.6 | 30.7 | 30.4 | 29.5 | 28.2 | 28.0 |
| | Adhesion Shearing Stress (g/cm$^2$ at 1200° C.) | 212 | 441 | 325 | 478 | 549 | 485 | 9 | 2 | <1 |
| | Stress (g/cm$^2$ at 1400° C.) | 50 | 222 | 129 | 265 | 313 | 307 | <1 | <1 | <1 |

TABLE 7

| Kind of Binders | (wt %) 2 | 3 | 4 | 8 | 10 | a | b |
|---|---|---|---|---|---|---|---|
| Sodium Tetrapolyphosphate | 4 | 2 | 2 | | | 4 | |
| Sodium Hexamethaphosphate | | 2 | 2 | | | | 4 |
| Soluble Sodium Silicate | | | | 2 | 2 | | |
| Calcium Hydroxide | | 0.5 | 0.5 | 0.5 | 0.5 | | |
| Sodium Silicate Glass | | | | 4 | 3 | | |
| Sodium Silicic Anhydride | | | 3 | | 1 | | |
| Carboxymethyl Cellulose | 0.4 | | | | | | |

As Table 6 shows, the samples containing at least one kind among the group comprising sodium silicate glass, sodium silicic anhydride and calcium hydroxide, in addition to condensed phosphate and soluble sodium silicate, have high adhesion shearing stress and improved adhesion to the furnace wall.

What is claimed is:

1. A method for hot repairing the inside of a high temperature furnace comprising the steps of forming a hot repair material in the state of a slurry by adding 10-15 weight % of water to a monolithic refractory material composed mainly of a refractory material and a binder, or a refractory in admixture with carbon containing granulated particles and additionally a binder; directing and compacting said repair material into portions necessitating repairs in the high temperature furnace; allowing the water in said repair material to boil; and hardening said monolithic refractory material by said boiling operation; said monolithic refractory material having a particle size composition of coarse particles of 1-10 mm in the range of 10-70 weight %, ultrafine particles below 0.063 mm in the range of 10-50 weight % and particles of 1-0.063 mm for the residual part.

2. The method for hot repairing the inside of a furnace as defined in claim 1 wherein there is used a monolithic refractory comprising 10-70 weight % carbon-containing granulated particles; the latter particles consisting of 30-90 weight % refractory and 10-70 weight % carbonaceous material.

3. The method according to claim 1 wherein there is used a monolithic refractory material containing carbon-containing granulated particles in which the ratio of the carbonaceous containing material to the monolithic refractory is 10-60 weight % and wherein said carbon-containing granulated materials contain 30-90 weight % of the refractory and 10-70 weight % of a carbonaceous material.

4. The method according to claim 1 wherein there is used a monolithic refractory material containing carbon-containing granulated particles in which the ratio of the carbonaceous containing material to the monolithic refractory is 10-60 weight % and wherein said carbon-containing granulated materials contain 30-90 weight % of the refractory and 10-70 weight % of a carbonaceous material.

5. A method according to claim 1 in which said refractory and carbon-containing granulated particle mixture slurry consists essentially of 30-90 weight % of a refractory; 5-25 weight % of a carbon material, 2-20 weight % of a carbonaceous resin and 5-40 weight % of pitch.

* * * * *

UNITED STATES PATENT AND TRADEMARK OFFICE

CERTIFICATE OF CORRECTION

PATENT NO. : 4,436,678

DATED : March 13, 1984

INVENTOR(S) : NISHIKAWA ET AL.

It is certified that error appears in the above-identified patent and that said Letters Patent is hereby corrected as shown below:

Kindly amend the above-identified patent as follows:

Column 13, line 56 (line 4 of Claim 1), change "10-15" to -- 10-50 --;

Column 14, cancel lines 45-52 (i.e. Claim 4 in its entirety);

Column 14, line 53, change "5." to -- 4. --.

Signed and Sealed this

*Fourth* Day of *February 1986*

[SEAL]

*Attest:*

*Attesting Officer*

DONALD J. QUIGG

*Commissioner of Patents and Trademarks*